United States Patent [19]

Terry

[11] 4,190,124

[45] Feb. 26, 1980

[54] STABILIZER AND BLADE ATTACHMENT MEANS THEREFOR

[75] Inventor: Robert G. Terry, Odessa, Tex.

[73] Assignee: Thomas L. Taylor, Odessa, Tex.

[21] Appl. No.: 954,044

[22] Filed: Oct. 23, 1978

[51] Int. Cl.[2] ..... E21B 9/22

[52] U.S. Cl. ..... 175/406; 175/325; 175/410; 308/4 A; 403/355; 403/DIG. 8

[58] Field of Search ..... 175/410, 406, 413, 346, 175/374, 366, 325, 412, 413; 403/355, 356, DIG. 8; 308/4 A; 166/241

[56] References Cited

U.S. PATENT DOCUMENTS

| | | | |
|---|---|---|---|
| 875,664 | 12/1907 | Karns | 175/413 |
| 1,233,175 | 7/1917 | Brewster | 403/DIG. 8 |
| 1,999,132 | 4/1935 | Reed | 175/346 |
| 2,084,430 | 6/1937 | Catland | 175/346 |
| 3,052,310 | 9/1962 | Kinzbach | 175/406 |
| 3,303,900 | 2/1967 | Kloesel, Jr. | 175/406 X |
| 3,454,308 | 7/1969 | Kennedy | 166/241 X |
| 4,108,692 | 8/1978 | Quinlan | 175/374 X |

*Primary Examiner*—James A. Leppink
*Assistant Examiner*—Richard E. Favreau
*Attorney, Agent, or Firm*—Marcus L. Bates

[57] ABSTRACT

A stabilizer for use in conjunction with a rotating drill string of a rotary drilling rig. The cutting blades of the stabilizer are received in close tolerance relationship within a longitudinally extending slot formed in a main body portion of the stabilizer. The slot outwardly opens and includes opposed sidewalls and opposed ends. The blades have opposed sidewalls and opposed ends and are made complementary respective to the geometrical configuration of the slot. A groove is formed in each sidewall of the slot and in each sidewall of the cutting blade such that when the blade is positioned within the slot, the grooves jointly form spaced cylindrical passageways. A plurality of holding balls fill the passageways and are removably captured therewithin, thereby releaseably securing the blade to the stabilizer body with great force so that the blade cannot inadvertently become lost downhole in a borehole.

17 Claims, 9 Drawing Figures

STABILIZER AND BLADE ATTACHMENT MEANS THEREFOR

BACKGROUND OF THE INVENTION

During borehole forming operations using a rotary drilling rig, it is customary to employ at least one, and usually several, series connected stabilizers. The stabilizers are generally placed in close proximity to the drill bit and form the dual function of reaming the borehole true while at the same time causing the drill bit to make the hole straighter.

A crooked borehole is undesirable for the reason that any subsequent running of a tool string or piping thereinto must follow a tortuous path which imposes undesirable bending moments into the downhole located equipment.

Various different stabilizers have been proposed in the prior art and include U.S. Pats. Nos. 3,052,310; 2,911,195; 2,872,159; 2,589,534; 2,607,561; and 1,590,422. These various different prior art tools represent but a few of the many stabilizers available to the oil industry. However, the means by which the cutting element or cutting blade is attached to the main stabilizer body is inadequate, and from time to time a blade will inadvertently loosen and fall to the bottom of the borehole. The blade has a very hard cutting edge or face formed thereon; and accordingly, the expensive drill bit is ruined when an attempt is made to "drill-up" the lost blade. Therefore, the blade, along with the various different associate parts employed to attach the blade to the body, must be fished from the borehole. A fishing job, especially on deep wells, is extremely expensive and is considered catastrophic in the science of forming boreholes.

Accordingly, it would be desirable to have made available a stabilizer apparatus having cutting blades removably affixed thereto which could not, under any circumstances, inadvertently part from the main body and fall to the bottom of the borehole. This desirable expedient would enable the massive main body of the stabilizer to be used again and again with only the relatively less expensive stabilizer blades being replaced from time to time. Such a desirable expedient is the subject of this invention.

SUMMARY OF THE INVENTION

A stabilizer having means by which each end thereof can be secured in series relationship respective to a drill string. A plurality of cutting blades are removably affixed to the stabilizer main body by the employment of two, spaced-apart, cylindrical passageways formed at the interface between the main body and the blades such that a plurality of holding balls can be placed within the passageway, thereby individually securing each of the blades to the main body.

More specifically, the main body of the stabilizer includes a plurality of radially spaced-apart, outwardly opening slots which extend more or less parallel respective to the borehole and to the central axis of the stabilizer. The slots are spaced apart circumferentially from one another and include spaced-apart, opposed sidewalls and spaced-apart, opposed endwalls.

The blades are received in close tolerance relationship within the slot with the cutting edge of the blade outwardly extending radially away from the longitudinal axial centerline of the stabilizer. The opposed sidewalls and opposed end walls of each blade is slidably received by the corresponding elements of the slot.

A longitudinally extending groove is formed in each sidewall of the blade and are disposed parallel respective to one another, while identical grooves are formed in the opposed sidewalls which form the slot. The grooves are positioned in such a manner that when a cutting blade is seated within a slot, the grooves of the blade and slot are aligned along a common centerline to thereby provide opposed, parallel, cylindrical passageways which are jointly formed by either side of the slot and the cutter blade. Holding balls are placed within the passageway. The passageway includes an inlet and an outlet, with the outlet being closed to prevent egress of the holding balls therefrom. The inlet has a removable closure means so that the balls can be placed into the passageway and removed therefrom, thereby enabling the tool to be serviced.

In one form of the invention, a holding block is removably secured within one marginal end of the slot, with the inlet to the passageway being formed through the block so that when the block and blade are properly positioned within the slot, the balls can be placed through the holding block and into the spaced parallel passageways.

Accordingly, a primary object of this invention is the provision of improvements by which a blade is removably attached to the main body of a stabilizer.

Another object of the invention is the provision of a blade and stabilizer combination which provides for the blade being removably attached to the stabilizer in such a manner that it can not inadvertently become dislodged therefrom.

A further object of this invention is the provision of improvements in method and apparatus by which a cutting blade is attached to the main body of a stabilizer.

A still further object of this invention is the provision of attachment means by which a stabilizer blade is removably secured to a stabilizer body by a plurality of balls received within a ball rereceiving passageway.

Another and still further object of this invention is the provision of an improved stabilizer having cutter blades removably attached thereto by a plurality of hard balls with the balls being placed within a cylindrical passageway mutually shared by both the blade and the main body, so that the balls bear against the blade and main body to prevent the blade from moving respective to the main body.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
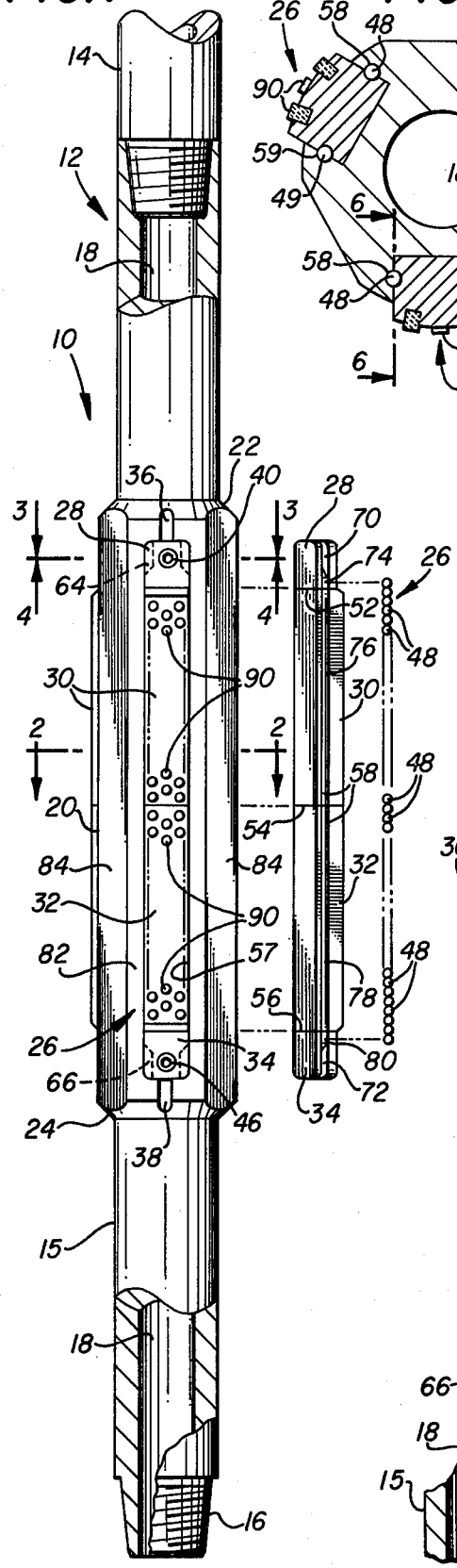
FIG. 1 is a part cross-sectional, side elevational view of a stabilizer made in accordance with the present invention.

In FIG. 1 there is disclosed part of a drill string 10 which includes a stabilizer 12 made in accordance with the present invention. A drill pipe 14 is attached to the upper end of the stabilizer, and the lower end 16 thereof is threaded in the usual manner for attachment to other drill pipe or to a bit. Passageway 18 extends along the longitudinal axial centerline of the tool.

The stabilizer is of generally cylindrical configuration and includes a large medial body portion 20 which is reduced at 22 and 24. A plurality of radially spaced cutting blade assemblies 26 are removably received within the medial body portion, with the blades illustrated herein as being circumferentially spaced apart from one another 120°, although any number of blades may be included.

Upper holding block 28 has an end portion thereof which abuttingly engages one end portion of an upper member 30 which forms the upper half of the blade. A lower half 32 of the blade likewise abuttingly engages a lower holding block 34. An upper, longitudinally disposed channel 36 upwardly and outwardly opens and extends into communication with the uppermost end of the holding block 28. A lower, longitudinally disposed channel 38 downwardly and outwardly opens and extends into communication with the lowermost end of the holding block 34. Plug 40 is removally secured within the upper holding block for a purpose which will be more fully discussed later on.

Figure 5:
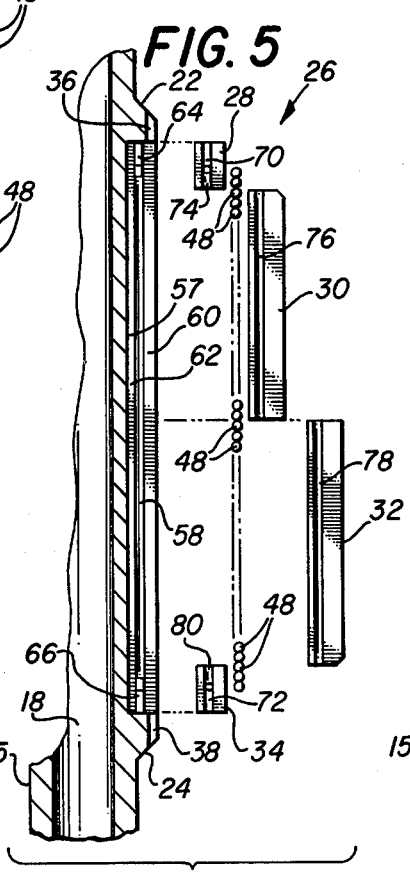
FIGS. 5 and 6 are fragmentary, enlarged, cross-sectional views taken along lines 5—5 and 6—6, respectively, of FIG. 2.
Figure 6:
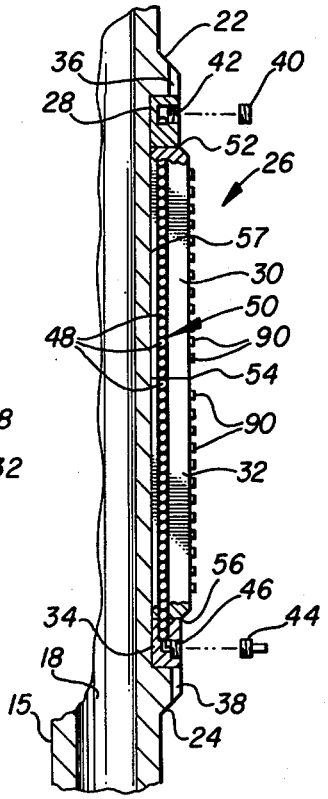
Figure 7:
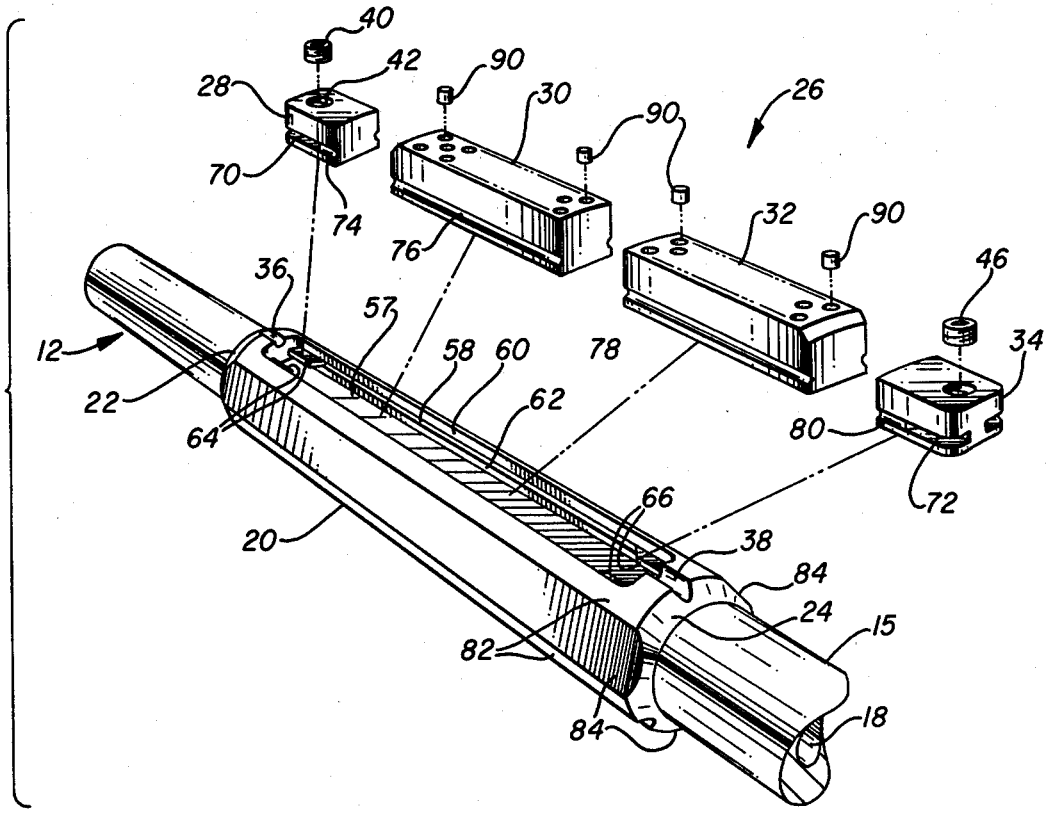
FIG. 7 is a perspctive view which discloses the tool of FIG. 1 in a disassembled configuration.
Figure 8:
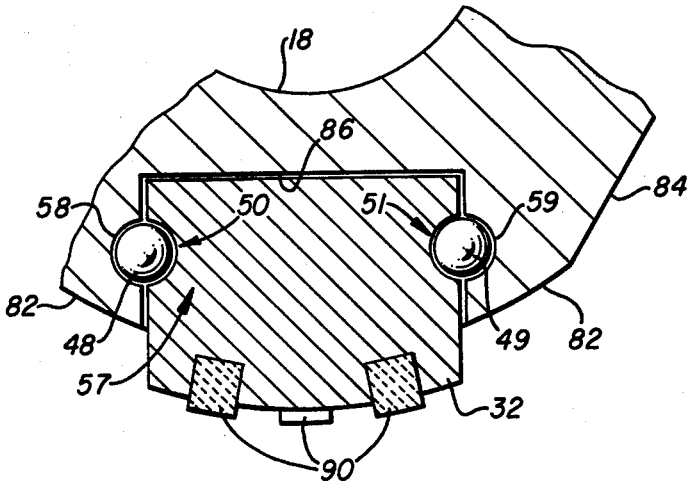
FIG. 8 is a fragmentary, enlarged, cross-sectional view of part of the apparatus disclosed in the foregoing figures; and, FIG. 9 is a schematical representation which sets forth the essence of the present invention.
Figure 9:
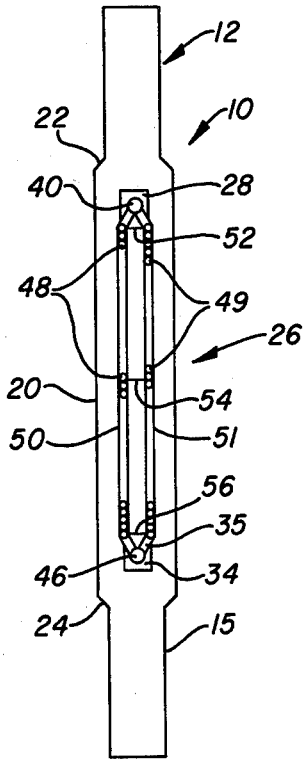

As best seen illustrated in FIGS. 5 and 6, the upper holding block is internally threaded at 42 for threadedly receiving the before mentioned plug. A lower plug 44 threadedly engages the interior of the lower holding block and is provided with a removable pipe nipple so that a source of compressed air can be attached thereto. A plurality of holding balls, 48 and 49, are received within a ball holding, cylindrical passageway 50.

Numerals 52, 54, and 56, respectively, indicate the interface formed between members 28 and 30, 30 and 32, 32 and 34, respectively. A longitudinally extending slot 57 is made complimentary respective to the configuration of the cutting blade and blocks, and receives the cutting blade in close tolerance relationship therewithin. A groove 58 extends along the major length of a sidewall of the slot and forms one half of the before mentioned cylindrical passageway. A similar groove also extends along the opposed sidewall of the slot. Numerals 60 and 62 illustrate that the sidewalls are flat parallel faces separated from one another by the groove 58.

The groove terminates at web members 64 and 66 which are formed at the opposed marginal ends of the slot and are placed in alignment therewith. The web members extend away from the sidewall of the slot inwardly towards one another, and preferably are joined to the endwalls of the slot.

As seen in FIG. 5, a square groove, 70 and 72, is formed in the upper and lower marginal ends of the sidewalls of the upper and lower blocks, while a cylindrical groove, 74 and 80, is formed adjacent thereto for receiving holding balls therewithin.

Grooves 76 and 78 cooperate together to form part of the cylindrical passageway 50. Hence grooves 74, 76, 78, and 80 are aligned with one another and with web members 70 and 72.

As seen in various figures of the drawings, the medial portion of the centralizer is of constant diameter in proximity of the slot and blades, and is provided with circumferentially spaced flat faces 84 at equal radially spaced locations between the various adjacent blades and slots. Numeral 86 indicates the rear or innermost face of the slot while numeral 90 indicates a number of carbide inserts which are pressed into the outer marginal face of the blades.

Figure 2:
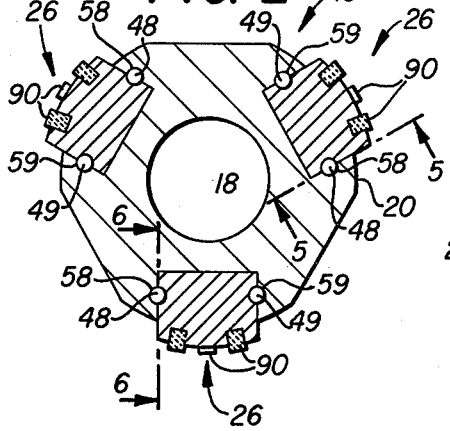
FIGS. 2, 3, and 4, respectively, are enlarged, cross-sectional views taken along lines 2—2, 3—3, and 4—4, respectively, of FIG. 1.
Figure 3:
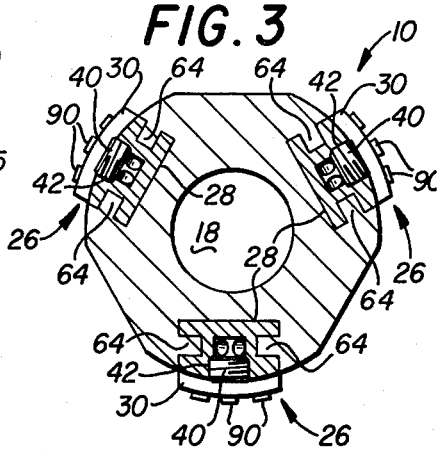
Figure 4:
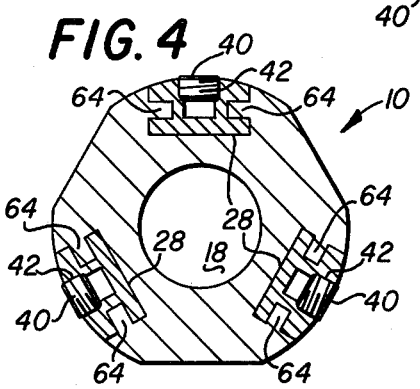

The stabilizer of the present invention preferably is cylindrical at each marginal end portion thereof, with the medial body portion being made into the configuration of FIG. 2. The slots 57 preferably are placed parallel to one another and concentrically arranged respective to the longitudinal axial centerline of the tool, with the cutters being concentrically arranged about the central passageway 18 which extends through the tool.

The slots are milled into the enlarged, medial body portion of the tool with the grooves 36 and 38 extending into communication with the slot, and with one of the grooves opening uphole and the other opening downhole so that the blocks can be easily forced from their illustrated seated position when it is necessary to overhaul the tool.

The tool is assembled by placing the holding blocks within the slot, and thereafter driving the upper holding block in an upward direction and the lower holding block in a lower direction until the blocks are seated in the manner of FIG. 1. This action causes the webs to enter the square grooves. The plug 40 is removed from the upper holding block and the components of the blade assembly are next tapped into seated position as illustrated in the drawings. Next the balls 48 are placed into the inlet 42 of the block passageway until the cylindrical passageway 50 located on either side of the blade is completely filled with balls. The plug 40 is tightly secured into position, thereby capturing the balls within the two opposed, cylindrical passageways of a blade. It will be noted that the outlet passageway 46 is of a diameter which precludes the balls being lost therethrough.

Where deemed desirable, the holding blocks 28 and 34 may be made an integral part of the main body, however, such an expedient complicates servicing the tool. Moreover, the blade components 30 and 32 may be of unitary construction rather than of two piece construction as shown in the drawings.

When it is necessary to replace the cutting blades, plugs 40 and 44 are removed from the inlet and outlet ends of the passageway, a nipple is screwed into the lower plug, and air pressure is applied thereto, thereby pneumatically forcing the balls to move through the cylindrical passageway and out of the upper holding block. The members 30 and 32, which form the cutting blade, are next removed by applying an outward force thereto. The holding blocks are next driven towards one another to free the web from the square groove by utilizing a drift pin conveniently placed within slots 36 and 38 so that the square grooves 70 and 72 are freed from the web members 64 and 66 as the upper and lower blocks are moved towards one another. The blocks thereafter can be lifted from the interior of the slot, the tool cleaned, and thereafter a new set of blades assembled thereon.

Where deemed desirable, the plugs 40 and 44 can be welded into position and the weld subsequently ground away in order to retrieve the balls which are captured within the cylindrical passageway.

With the tool assembled in the above described manner, it is virtually impossible to dislodge any of the cutting blades because of the tremendous bearing pressures developed between the outer peripheral surface of the holdings balls and the inner wall surface of the cylindrical passageway.

As pointed out above, each of the cutting blades can be made from a plurality of from a single blade, as may be desired. The number of circumferentially spaced-apart blades can vary in number, and the holding blocks may be made an integral part of the main body of the tool, if desired. The web members 64 and 66 can extend along the entire length of the holding block, or alternatively, the web members can be dispersed with and the cylindrical groove extended along the entire sidewalls of the upper and lower holding members and the slot.

In one embodiment of the invention, the slot was made 2¾ inches×36 inches, with the cutting surface of the blade extending ⅜inch radially away from the surface of the main body. The holding balls are ½inch outside diameter while the outside diameter of the enlarged portion of the main body is 7 inches. The total length of the stabilizer is 7½ feet while the inside diameter of the internal passageway 18 is 2¼ inches.

Where deemed desirable to do so, the balls may be attached together by a 1/16 inch diameter wire rope, much like a string of pearls, to facilitate installation and removal from the tool. The balls need not be surface hardened and can be made of any material which is compatible with the downhole conditions.

I claim:

1. A stabilizer of generally cylindrical configuration having means at the upper and lower end thereof by which the stabilizer can be connected in series relationship with respect to a drill string; an axial flow passageway formed through said stabilizer through which drilling fluid can flow;

said stabilizer having a central body within which a plurality of elongated, outwardly opening, radially spaced slots are formed; each said slot being spaced circumferentially from the nearest adjacent slot; each said slot having opposed sidewalls and opposed endwalls, and a bottom spaced from said axial flow passageway; said opposed sidewalls extend from said bottom to the outer peripheral surface of said central body;

a cutting blade having opposed ends, opposed sidewalls, and a front and a rear face; means on said front face for reaming the inside peripheral wall surface of a borehole true; one said blade being received within one said slot in close tolerance relationship therewith, the sidewalls of said blade being closely adjacent to the sidewalls of said slot;

an elongated, longitudinally extending, circular groove formed on each said opposed wall surface of said slot and on each said opposed sidewall of said blade; one said groove, when said blade is received within said slot, registers with another said groove to form a cylindrical passageway, said passageway having an inlet end and an outlet end, a closure means for said inlet end and said outlet end;

and a plurality of holding balls removably received within said cylindrical passageway, said balls have an outside diameter to be admitted within said cylindrical passageway;

one said blade can be received within one said slot, said plurality of holding balls can be forced through said inlet end of said passageway until said passageway is substantially filled with balls, the closure means positioned to isolate the balls within the passageway where each of the balls simultaneously bear against the circular groove of the slot and the circular groove of the blade, thereby holding the blade within the central body.

2. The stabilizer of claim 1 wherein said slots are positioned parallel respective to said axial passageway, said cutting blades are concentrically arranged about said axial passageway, said balls being placed adjacent to one another and essentially completely filling said cylindrical passageway.

3. The stabilizer of claim 1 wherein said inlet to said passageway is of a size to admit a ball thereinto while said outlet is smaller in diameter respective to said ball.

4. The stabilizer of claim 1 wherein a holding block is removably received within one marginal end of said slot, said holding block having opposed ends and opposed sides, one end of said block abuttingly engaging one end of said slot and the other end of said block abuttingly engaging one end of said cutting blade, and means securing said block within said slot.

5. The stabilizer of claim 4 wherein said slots are positioned parallel respective to said axial passageway, said cutting blades are concentrically arranged about said axial passageway, said balls being placed adjacent to one another and essentially completely filling said circular passageway.

6. The stabilizer of claim 5 wherein said means securing said block within said slot includes opposed web members extending from said sides of said block, there being a groove formed in opposed sidewalls of said slot for receiving said web members therein so that the block can be positioned within said slot and moved toward the endwall thereof so that the web memers register with the grooves thereby preventing outward movement of said block.

7. A stabilizer tool apparatus comprising a tubular body having threaded opposed ends by which the stabilizer can be series connected into a drill string;

a plurality of slots for receiving cutting blades therein, each said slot being outwardly opening and having an innermost face from which opposed ends and opposed sidewalls outwardly extend towards the outer peripheral surface of the tool;

a plurality of cutting blades, one of said plurality of cutting blades being received in close tolerance relationship within one of said plurality of slots, with the sides and ends of the cutting blade being placed against the sides and ends of the slot; said cutting blade has an outer face and an inner face, with said outer face being opposed to said inner face, said inner face is positioned parallel and adjacent to the innermost face of the slot; said outer face of said blade having means thereon for reaming a borehole true;

said sides of said blade and said sides of said slot having an elongated cavity formed therein, said elongated cavity of said blade and slot being aligned with one another to form a cylindrical passageway on either side of said cutting blade when said blade is seated within said slot, said passageway having an inlet end, a plurality of balls extending substantially along the entire length of said cylindrical passageway, said balls having a diameter substantially equal to the diameter of the passageway; a removable closure means for said inlet end so that said balls are captured within said passageway;

one said blade can be received within one said slot, said plurality of holding balls can be forced through said inlet end of said passageway until said passageway is substantially filled with balls, the closure means positioned to isolate the balls within the passageway where each of the balls simultaneously bear against the circular groove of the slot and the circular groove of the blade, thereby holding the blade within the central body.

8. The tool of claim 7 wherein said tubular body has an axial passageway formed therethrough, said slots are positioned parallel respective to said axial passageway, said cutting blades are concentrically arranged about said axial passageway, said balls being placed adjacent to one another and essentially completely filling said cylindrical passageway.

9. The tool of claim 8 wherein said inlet end of said passageway is of a size to admit a ball thereinto, and further including an outlet end which is smaller than a ball, so that a force can be applied at said outlet end to force the balls from the cylindrical passageway.

10. The tool of claim 7 wherein a holding block is removably received within one marginal end of said slot, said holding block having opposed ends and opposed sides, one end of said block abuttingly engaging one end of said slot and the other end of said block abuttingly engaging one end of said cutting blade, and means securing said block within said slot.

11. The tool of claim 10 wherein said means securing said block within said slot includes opposed web members extending from the sides of said block, there being a groove formed in opposed walls of said slot for receiving said web members therein so that the block can be positioned within said slot and moved toward one end thereof so that the web members register with the grooves thereby preventing outward movement of said block.

12. Method of attaching a cutting blade to a stabilizer comprising the steps of:

(1) forming a plurality of radially spaced, outwardly opening slots within the main body of the stabilizer and circumferentially spacing the slots from one another;

(2) forming a plurality of cutting blades of a size to be received within said slots such that a cutting face of the blade extends in spaced relationship to the outer peripheral surface of the stabilizer body;

(3) forming spaced parallel grooves in the sidewalls of the slots and in the sidewalls of the blades at a location whereby pairs of grooves register with one another when a blade is seated within a slot to form a cylindrical passageway;

(4) selecting a plurality of holding balls having a diameter substantially equal to the diameter of said cylindrical passageway;

(5) substantially filling the cylindrical passageway with said balls and capturing the balls within the passageway to thereby lock the blade within the slot.

13. The method of claim 12 and further including the step of forming an outlet to said passageway which is smaller in size than the outside diameter of the balls, and further including the step of forming a closure means at said inlet so that the balls are captured within the passageway.

14. The method of claim 12 and further including the steps of:

forming a holding block which is received in close tolerance relationship within one marginal end of said slot and removably securing said block into position;

forming said inlet of said passageway within said block;

securing said block into proper position within said slot, positioning said blade within said slot; and forcing the balls through said inlet, into said passageway, and thereafter closing said inlet.

15. A stabilizer of generally cylindrical configuration having means at the upper and lower end thereof by which the stabilizer can be connected in series relationship with respect to a drill string; an axial flow passageway formed through said stabilizer through which drilling fluid can flow;

said stabilizer having a central body within which a plurality of elongated, outwardly opening, radially spaced slots are formed; each said slot being spaced circumferentially from the nearest adjacent slot; each said slot having opposed sidewalls and opposed endwalls, and a bottom spaced from said axial flow passageway; said opposed sidewalls extend from said bottom to the outer peripheral surface of said central body;

a cutting blade having opposed ends, opposed sidewalls, and a front and a rear face; means on said front face for reaming the inside peripheral wall surface of a borehole true; one said blade being received within one said slot in close tolerance relationship therewith, the sidewalls of said blade being closely adjacent to the sidewalls of said slot;

an elongated, longitudinally extending circular groove formed on each said opposed wall surface of said slot and on each said opposed sidewall of said blade; one said groove, when said blade is received within said slot, registers with another said groove to form a cylindrical passageway, said passageway having an inlet end and an outlet end, a closure means for said inlet end and said outlet end;

and a plurality of holding balls removably received within said cylindrical passageway, said balls having an outside diameter to be admitted within said cylindrical passageway;

said inlet to said passageway is of a size to admit a ball thereinto while said outlet is smaller in diameter respective to said ball.

16. A stabilizer of generally cylindrical configuration having means at the upper and lower end thereof by which the stabilizer can be connected in series relationship with respect to a drill string; an axial flow passageway formed through said stabilizer through which drilling fluid can flow;

said stabilizer having a central body within which a plurality of elongated, outwardly opening, radially spaced slots are formed, each said slot being spaced circumferentially from the nearest adjacent slot; each said slot having opposed sidewalls and opposed endwalls, and a bottom spaced from said axial flow passageway; said opposed sidewalls extend from said bottom to the outer peripheral surface of said central body;

a cutting blade having opposed ends, opposed sidewalls, and a front and a rear face; means on said front face for reaming the inside peripheral wall surface of a borehole true; one said blade being received within one said slot in close tolerance relationship therewith, the sidewalls of said blade being closely adjacent to the sidewalls of said slot;

an elongated, longitudinally extending circular groove formed on each said opposed wall surface of said slot and on each said opposed sidewall of said blade; one said groove, when said blade is received within said slot, registers with another said groove to form a cylindrical passageway, said passageway having an inlet end and an outlet end, a closure means for said inlet end and said outlet end;

and a plurality of holding balls removably received within said cylindrical passageway, said balls have an outside diameter to be admitted within said cylindrical passageway;

said slots are positioned parallel respective to said axial passageway, said cutting blades are concentrically arranged about said axial passageway, said balls being placed adjacent to one another and essentially completely filling said circular passageway.

17. Method of attaching a cutting blade to a stabilizer comprising the steps of:

(1) forming a plurality of radially spaced, outwardly opening slots within the main body of the stabilizer and circumferentially spacing the slots from one another;

(2) forming a plurality of cutting blades of a size to be received within said slots such that a cutting face of the blade extends in spaced relationship to the outer peripheral surface of the stabilizer body;

(3) forming spaced parallel grooves in the sidewalls of the slots and in the sidewalls of the blades at a location whereby pairs of grooves register with one another when a blade is seated within a slot to form a cylindrical passageway;

(4) substantially filling the cylindrical passageway with balls and capturing the balls within the passageway to thereby lock the blade within the slot;

(5) forming an outlet to said passageway which is smaller in size than the outside diameter of the balls; and, (6) forming a closure means at said inlet so that the balls are captured within the passageway.

* * * * *